United States Patent [19]

Solheim

[11] Patent Number: 4,596,328

[45] Date of Patent: Jun. 24, 1986

[54] THROAT STRUCTURE FOR GOLF CLUB BAGS

[76] Inventor: John A. Solheim, 529 W. Wakonda La., Phoenix, Ariz. 85023

[21] Appl. No.: 587,453

[22] Filed: Mar. 8, 1984

[51] Int. Cl.[4] ..... A63B 55/00

[52] U.S. Cl. ..... 206/315.6; 206/315.3

[58] Field of Search ..... 206/315.2, 315.3, 315.4, 206/315.5, 315.6, 315.7, 315.8; 280/DIG. 6; 248/96; 211/70.2

[56] References Cited

U.S. PATENT DOCUMENTS

| | | | |
|---|---|---|---|
| 1,271,784 | 7/1918 | Simpson | 206/315.6 |
| 1,838,699 | 12/1931 | McMonies et al. | 206/315.6 |
| 1,968,723 | 7/1934 | Thorsen | 206/315.6 |
| 2,256,521 | 9/1941 | Kirkpatrick et al. | 206/315.3 |
| 2,282,842 | 5/1942 | Abell | 206/315.7 X |
| 3,139,132 | 6/1964 | Shiller | 206/315.6 |
| 3,534,795 | 10/1970 | Wiedenmeier | 206/315.6 |
| 4,130,153 | 12/1978 | Zopf | 206/315.6 |
| 4,266,589 | 5/1981 | Cochran | 206/315.3 |
| 4,332,283 | 6/1982 | Rader | 206/315.6 |

FOREIGN PATENT DOCUMENTS

| | | | |
|---|---|---|---|
| 21884 | 9/1930 | Australia | 206/315.5 |
| 206625 | 11/1923 | United Kingdom | 206/315.5 |
| 607387 | 5/1948 | United Kingdom | 280/DIG. 6 X |
| 859116 | 1/1961 | United Kingdom | 206/315.7 |

*Primary Examiner*—William Price
*Assistant Examiner*—Sue A. Weaver
*Attorney, Agent, or Firm*—Herbert E. Haynes, Jr.

[57] ABSTRACT

A throat structure for use in the open top of a golf bag includes the combination of a ring-shaped body with a special divider therein which separates the opening into the golf bag into four golf club segregation areas. The special divider is provided with a pair of cross bars that are interconnected at their centers by a transverse rib with the cross bars being angular so that the golf clubs containable in the segregation areas will tend to collect in predetermined locations in the segregation areas when the golf bag is being carried to facilitate golf club selection and removal and to minimize golf club entanglement.

18 Claims, 7 Drawing Figures

THROAT STRUCTURE FOR GOLF CLUB BAGS

BACKGROUND OF THE INVENTION

1. Field of the Invention

This invention relates generally to bags for carrying golf clubs and more particularly to an improved throat structure for facilitating placement and removal of the golf clubs in the bag and providing improved golf club group segregation.

2. Description of the Prior Art

Golf clubs have been stored, carried, and otherwise transported in especially designed golf bags for many years. Most golf bags are in the form of a tubular fabric container generally of cylindrical configuration having a closed bottom and an open top, or throat, through which the golf clubs are inserted into and removed from the bag. When golf clubs are in such bags, the grips of the clubs are in resting engagement with the closed bottom of the bag, and the heads of the clubs extend more or less axially from the open throat of the bag. By positioning the golf clubs in the bag in this manner, the clubs can be identified for club selection purposes by a golfer in that the configurations of the heads vary in accordance with the intended usage and are for the most part generally provided with suitable identifying indicia.

Although the number of golf clubs carried in golf bags will vary, the rules of golf dictate that the maximum number of clubs carried while playing will be fourteen. From this, it will be appreciated that even though the clubs vary in configuration and are provided with identifying indicia, selecting a desired club from the relatively large number of clubs can be distracting and sometimes frustrating. And, after the desired club has ben identified, removal of the club is not always easy in that the clubs can, and often do, become entangled in the bag.

For the above reasons, most golf bags are provided with throat structures which separate the clubs into segregated groupings which are, of course, determined by individual preference. For example, the woods are usually segregated by the throat structure of the golf bag into one group, the low number, or long and middle distance irons into another group, and the higher number, or short distance irons, and the putter into a third group.

The open top, or throat structure of most prior art golf bags are usually in the form of a substantially circular ring-shaped body having a spaced pair of linear dividers placed therein so that the dividers form equal chords within the circular ring-shaped body. The dividers are usually tubular structures formed by folding a relatively heavy gage, usually synthetic, leather-like material, and stitching the aligned longitudinal edges together. Such dividers are normally mounted in the ring-shaped body by an elongated strap which is threadingly passed through the tubular dividers and through suitable openings in the body with a buckle being used to secure the strap, and thus the dividers in place.

In throat structures which are divided as described above into three approximately equally sized open areas, most golfers place their woods, usually three, in one area, their putter and three or so short distance irons in another area, with the central area being used for containment of the middle and long distance irons. While these three open areas are a considerable improvement over a non-divided throat structure with regard to segregation and ease of club removal, the club entanglement problem is still quite bad particularly with regard to the central opening which can contain as many as seven or eight clubs if the golfer divides the clubs in the usual manner as described above.

In some golf bags, a third divider is sometimes employed to further provide the throat structure with an additional number of club separating open areas. The third divider is formed in the same manner as described above and is mounted below the other two dividers and lies on a diameter of the ring-shaped body and is transverse with respect to the other two dividers. Therefore, the third divider will provide six separate openings through the ring-shaped body. This type of throat structure is limited for use in relatively large diameter golf bags in that if used in relatively smaller diameter bags, the open area of each of the six openings would be too small and would therefore hamper facile insertion and removal of the golf clubs.

In view of the above, it will be seen that in most instances, the three open golf club segregation areas in many of the prior art golf bags is not enough for ideal golf club group segregation purposes, and the six open areas provided in other prior art structures is too many.

In yet another prior art golf bag, the throat structure is divided into four open club segregation areas which is believed to be a proper number for ideal club group segregation purposes. This four open club segregation area throat structure is formed by employing the two linear dividers in the ring-shaped body, in the same manner as the first hereinbefore described throat structure, and interconnecting the dividers with a cross rib at the centers thereof. This divides the central opening into two equal halfs.

In all prior art golf bags known to me, another shortcoming exists, and for clarity of the description of this shortcoming the first hereinbefore described prior art golf bag throat structure will be employed in the description.

As is well known, when a golf bag is carried it will normally be disposed at an angle relative to the ground with the throat structure of the bag lying in a more or less upwardly facing angular attitude. Therefore, the open golf club group segregation areas provided in the golf bag throat structures may be defined as including an upper opening, an intermediate opening, and a lower opening. The lower portions of the upper and intermediate openings are defined by the linear dividers and when a golf bag is being carried, those linear dividers ideally lie in a horizontal attitude, with the shafts of the golf clubs resting thereon. However, it is virtually impossible to keep those dividers in the desired horizontal attitude and the result is that the golf clubs will tend to collect in one corner or the other of their respective segregated opening. This will not happen in the lower compartment in that the bottom portion thereof is defined by an arcuate part of the ring-shaped body. When the golf clubs gather in the corners as described above, the golf clubs in the upper and intermediate openings will gather in adjacent corners of their respective openings. This causes shifting and uneven weight distribution in the golf bag which makes it more difficult to carry the bag. However, a more troublesome problem results from the heads of the golf clubs becoming entangled, making individual club identification and extraction more difficult.

Another problem with the above described prior art golf bag throat structures is that of the golf clubs hanging-up, or catching in the throat structures as the clubs are being extracted from the golf bag. The grips provided on golf clubs are, by necessity, of larger diameter than the shafts of the clubs. Therefore, the grips present an annular lip which faces upwardly toward the throat structure when the golf clubs are in the golf bag. Also, the golf club grips are tapered so that they gradually increase in diameter from the lips to the terminal ends thereof. A large part of the catching problem occurs at the corners of the open club segregation areas defined by the throat structures. In other words, at the intersections of the ends of the dividers and the ring-shaped body, and at the intersections of the dividers themselves in throat structures which are divided into more than the three open golf club segregation areas. The lip of the golf club grips often catch in these corners and sometimes the clubs become wedged therein due to the tapered configuration of the grips.

Therefore, a need exists for a new and improved golf bag throat structure which overcomes some of the problems and shortcomings of the prior art.

SUMMARY OF THE INVENTION

In accordance with the present invention, a new and improved golf bag throat structure is disclosed which has improved golf club segregation properties and improved golf club insertion and extraction characteristics.

The improved golf bag throat structure includes a ring-shaped body having a divider means which provides four especially configured open golf club segregation areas in the throat. The divider means includes a pair of angularly bent and oppositely facing cross bars, each having a pair of arms which extend oppositely at a diverging angle from the center toward the ring-shaped body. The angular cross bars are disposed in the ring-shaped body with their centers in spaced apart relationship, and the centers are interconnected by a relatively short center rib. The pair of arms of each cross bar are preferably disposed to define an obtuse included angle with the included angle between the adjacent pairs of the arms of the two cross bars being acute.

With the divider means being configured as described above, and with a relatively short center rib, a pair of open diametrically opposed relatively large golf club segregation areas, i.e., the upper and lower openings, are provided, with the transverse diametrically opposed pair of open segregation areas, i.e., the intermediate openings, being relatively small.

The upper open segregation area is bounded on the bottom portion by the two arms of one of the divider cross bars with the two arms thereof sloping toward the center of that cross bar. Thus, when a golf bag having the throat structure of the present invention is being carried, the clubs that are grouped in the upper open segregation area will tend to be concentrated at a point slightly above the center of the ring-shaped body. The golf clubs grouped in the lower segregation opening, will tend to be concentrated in the center at the bottom of the ring-shaped body due to the arcuate portion of the ring-shaped body which defines the lower part of the lower opening. The golf clubs which are disposed in the two intermediate open segregation areas will tend to be concentrated at opposite sides of the ring-shaped body at the lowermost outwardly disposed corners of their respective open segregation areas due to the downwardly and oppositely sloping arms of the lower divider cross bar.

In view of the above, it will be seen that the above described dividing means will separate the groups of golf clubs as far apart from each other as is possible within the confines of the ring-shaped body, and will tend to hold the separated groupings in the widely separated locations, thus eliminating, or at least minimizing the prior art weight shifting problem and the head entanglement problem resulting from the different club groupings gathering in adjacent corners of their respective open segregation areas.

The problem with golf clubs catching in the prior art golf bag throat structures when the clubs are being extracted therefrom is eased in the throat structure of the present invention by providing relatively large radii in the corners of the open areas, and the radii are sized to be at least approximately equal to the radius of the large end of golf club grips.

In a first embodiment of the golf bag throat structure of the present invention, the ring-shaped body and the divider means are molded or otherwise formed as a unitary structure from a suitable synthetic resin. In a second embodiment, the divider means and the ring-shaped body are made as separate pieces which are assembled during fabrication of a golf bag. The assembly may be accomplished in various suitable ways, such as by using fasteners, rivets for example, or by the conventional method of threadingly passing a strap through the divider means and the ring-shaped body and using a buckle to demountably secure the strap, and thus the divider means, in the body.

Accordingly, it is an object of the present invention to provide a new and improved open top, or throat structure for use in golf bags.

Another object of the present invention is to provide a new and improved golf bag throat structure which is configured to provide improved golf club group segregation characteristics and has improved golf club extraction properties.

Another object of the present invention is to provide a new and improved throat structure for golf bags which includes a ring-shaped body having a divider means therein which provides four especially configured open and separated areas which inherently keeps golf club groupings in widely spaced locations during the carrying of the golf bag.

Another object of the present invention is to provide a new and improved golf bag throat structure of the above described character wherein the divider means includes a spaced pair of angular cross bars which are interconnected at their centers to provide the four open and separated golf club group segregation areas.

Another object of the present invention is to provide a new and improved golf bag throat structure of the above described character wherein the angular divider means is configured to provide a first pair of diametrically opposed open segregation areas and a second pair of disposed diametrically opposed open segregation areas with the second pair being transversely disposed with respect to the first pair.

Another object of the present invention is to provide a new and improved golf bag throat structure of the above described type wherein the angular cross bars face in opposite directions and each has an oppositely and angularly diverging pair of arms which define an included obtuse angle with adjacent pairs of the arms of the cross bars defining an acute included angle.

Still another object of the present invention is to provide a new and improved golf bag throat structure of the above described character wherein the corners of each of the four open and separated golf club segregation areas are formed with radii which are at least substantially equal to the largest radius provided on a golf club grip to minimize golf club hang-up, or catching on the throat structure when the clubs are being extracted from the golf bag.

The foregoing and other objects of the present invention, as well as the invention itself, may be more fully understood from the following description when read in conjunction with the accompanying drawings.

DESCRIPTION OF THE PREFERRED EMBODIMENTS

Figure 1:
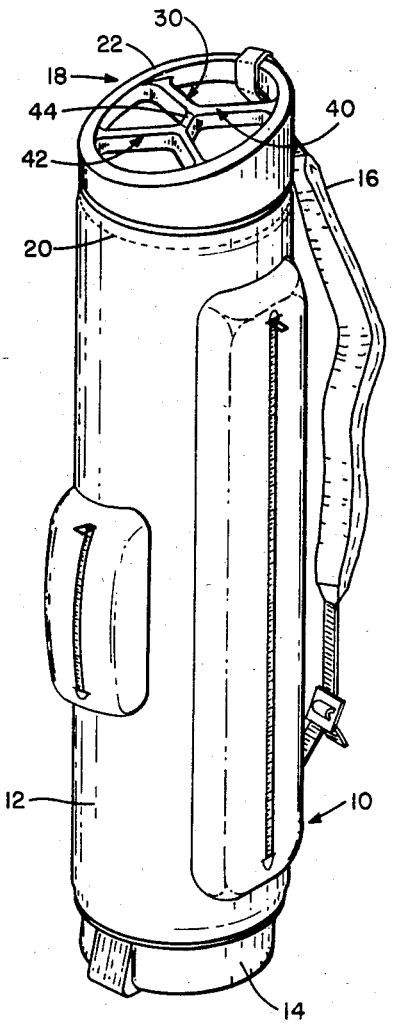
FIG. 1 is a perspective view of a typical golf bag which is provided with the throat structure of the present invention.

Referring more particularly to the drawings, FIG. 1 shows a typical type of golf bag structure which is identified in its entirety by the reference numeral 10. As is customary, the golf bag 10 includes a tubular container body 12 which, in light weight and relatively small golf bags, such as the one shown in FIG. 1, is usually formed of a suitable synthetic material, such as nylon. In larger and heavier golf bags (not shown) a heavier fabric, such as vinyl coated cloth is most often used. The bag 10 further includes a bottom closure member 14 which is a cup-shaped rigid structure that is stitched or otherwise fastened in the bottom of the tubular body 12. A suitable carrying strap 16 is also provided as is customary.

As will hereinafter be described in detail, the golf bag 10 is provided with an especially configured open top, or throat structure 18, which is suitably mounted in the top of the tubular container body 12 such as by sewing as indicated at 20 in FIG. 1.

Figure 2:
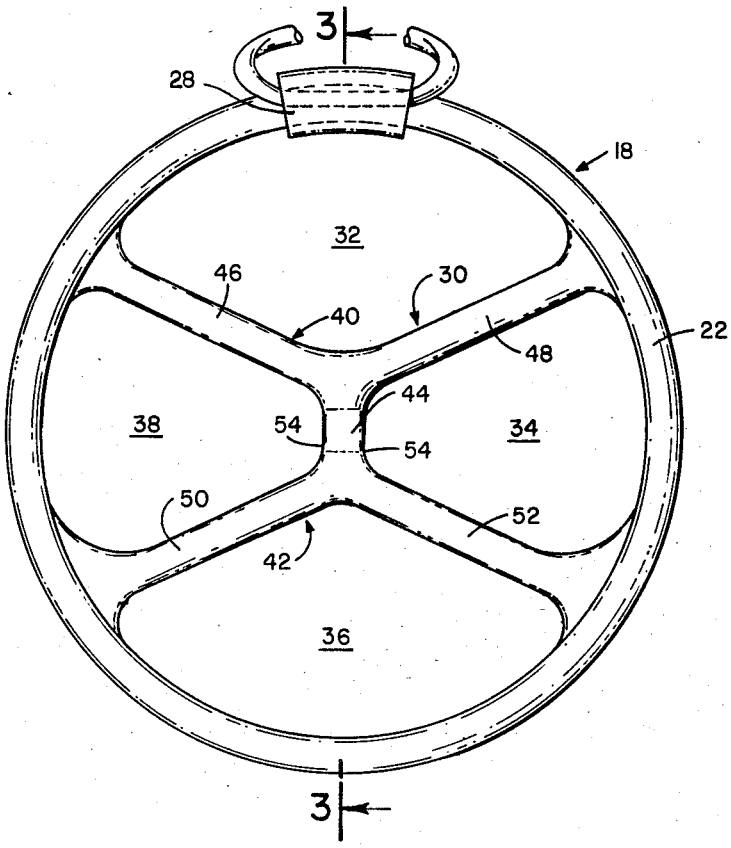
FIG. 2 is an enlarged plan view of a first embodiment of the golf bag throat structure of the present invention showing the various features thereof.
Figure 3:
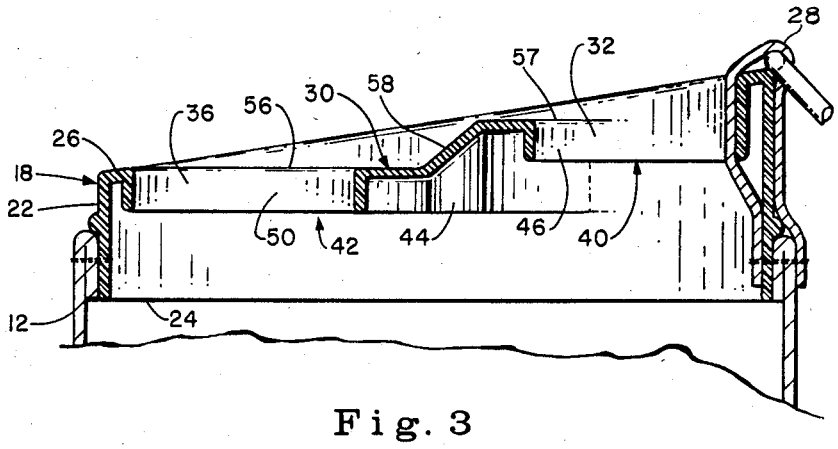
FIG. 3 is a sectional view taken along the line 3—3 of FIG. 2.

As seen best in FIGS. 2 and 3, the throat structure 18 includes a ring-shaped body 22 of substantially cylindrical configuration, with the lower edge 24 lying in a plane transverse to the axis of the body and the upper edge 26, which is rolled over as shown, lying in a plane which is angularly disposed with respect to the axis. This angular orientation of the upper edge 26 or the known alternative of an axially offset two-tier, or stepped upper edge (not shown) of the ring-shaped body is well known in the art and is employed for access and bag balancing purposes.

As shown, the carrying strap 16 is attached to the highest point on the ring-shaped body 22. This is done for the above mentioned bag balancing purpose and the strap 16 may be attached in various ways, such as by means of a suitable flap 28 which is looped over the ring-shaped body 22 and is suitably secured thereto so as to captively retain a metallic ring to which the strap 16 is demountably attached such as by means of a suitable clip.

The throat structure 18 further includes a divider means 30 which, in this first embodiment, is molded or otherwise integrally formed with the ring-shaped body 22. The divider means 30 is configured to divide the bore of the ring-shaped body into four open golf club group segregating areas, 32, 34, 36 and 38, and this is accomplished by a pair of cross bars 40 and 42, which are spaced apart and having their centers interconnected by a rib 44. The cross bars 40 and 42 are curved or otherwise bent at their centers to provide the cross bar 40 with a pair of arms 46 and 48 which extend at a diverging angle from one end of the center rib 44 and to similarly provide the other cross bar 42 with a pair of arms 50 and 52 which extend at an oppositely facing diverging angle from the opposite end of the center rib 44. The diverging, or included angles between the arms 46 and 48 of the cross bar 40 and the arms 50 and 52 of the cross bar 42 are preferably obtuse which, of course, results in the included angles between the adjacent arms 46 and 50, and the adjacent arms 48 and 52 being acute. The specific angles are not critical, however, excellent golf club group segregating characteristics result from orienting the arms 46, 48, 50 and 52 of the cross bars 40 and 42, respectively, so that the included obtuse angles are approximately 130°, and the acute included angles are approximately 50°. When configured in this manner, the diametrically opposed pair of open segregating areas 32 and 36 are relatively large and ideal for segregating, for example, the woods of a golf club set (not shown) in the area 32, with the putter and short distance irons in the area 36. The transverse diametrically opposed open areas 34 and 38 are relatively smaller and are ideal for jointly segregating the middle and long distance irons of the golf club set (not shown).

As hereinbefore described, when a golf bag is being carried by means of the shoulder strap 16, it will normally be oriented so that the open area 32 will be at the top or upper part of the body 22, the open area 36 will be at the lower part of the body, and the open areas 34 and 38 will be intermediate and laterally disposed in the ring-shaped body. This type of orientation is indicated best in FIG. 2, and due to the above described angular relationships of arms 46, 48 and 50, 52, of the divider cross bars 40 and 42, respectively, the golf club groupings (not shown) will tend to gather and be held in specific locations within the open segregation areas. Due to the upwardly opening angular orientation of the divider cross bar 40, the golf club group (not shown) containable in the upper open segregation area 32 will tend to gather and stay at the center of that cross bar. Of course, all the clubs can't simultaneously occupy the exact central location. Therefore, the clubs will be spread along the cross bar somewhat. Due to this, the heads of the clubs located in the upper segregation area 32 will hang down, and thus more or less overlay the central rib 44. The golf club grouping in the open bottom segregation area 36 will similarly gather and stay in the center part of the arcuate portion of the ring-shaped body 22 which defines the lower part of the bottom area, as is usual in most golf bags. The heads of the clubs located in the open bottom area 36 will hang down and thus not overlay any portion of the bore of the ring-shaped body. The right hand, as viewed in FIG. 2, intermediate area 34 is configured so that the golf club grouping containable in that area will tend to gather and stay in the corner formed at the intersection of the downwardly angularly extending arm 52 and that arcuate portion of the ring-shaped body 22 which bounds the right hand side of the open area 34. Some of the heads of the clubs containable in the right hand open segregation area 34 will hang down over the right hand side of the bottom open area 36 while others will be outside of the ring-shaped body 22 to the right and somewhat above the heads of the clubs containable in the bottom segregation area 36. Similarly, the golf club grouping containable in the left hand intermediate open segregation area 38 will tend to gather and stay in the lower left corner formed by the intersection of the angularly and downwardly sloping arm 50 and the arcuate portion of the ring-shaped body 22 which defines the left side of the open area 38. The heads of the clubs containable in that open area 38 will hang down in the same manner as those in the right hand open area 34 and thus will be generally to the left of the center of the open bottom area 36.

As shown, the opposite sides of the center rib 44 are curved as indicated at 54 in FIG. 2. The extending ends of the arms 46, 48, 50 and 52, are also curved, or flared, at the junctions of those arms with the ring-shaped body 22, and the cross bars 40 and 42 are curved in the central areas thereof where they are bent. Therefore, each corner within the entire throat structure 18 has a relatively large radius, and those radii are selected to minimize the catching, or hanging-up of the golf clubs when they are being extracted from the golf bag 10. The different corner radii in the throat structure 18 are sized so that they are at least substantially equal to the radius of the largest part of golf club grips. In this manner, problems of the clubs becoming wedgingly caught in the corners of the throat structure, and the lips of the golf club grips catching in those radiused corners is substantially reduced.

As seen best in FIG. 3, the divider means 30 is preferably recessed axially from the top surface 26 of the ring-shaped body 22. And, the divider means 30 is preferably configured so that the upper surfaces 56 and 57 of the cross bars 40 and 42, respectively, lie in different axially spaced parallel planes, and the upper surface 58 of the center rib 44 extends angularly between the cross bars to form a transition surface. None of these features are critical in that the objectives of the invention would be achieved with no axial recessing of the divider means 30, or by being further recessed than is shown, and, obviously, the axially spaced top surface placement of the divider means 30 may be varied.

The throat structure 18 fully described above is molded or otherwise formed as a unitary structure of a suitable material, such as synthetic resin. This type of structure is suitable for use with many golf bags, particularly the light weight relatively small carrying bags. However, the throat structure 18 is not well suited for use in some golf bags, mainly the larger and heavier bags due to the manner in which that type of golf bag is made. In these heavier types of golf bags, it is a common practice to use a metallic ring 60, as shown in FIGS. 4, 5, 6 and 7, which is wrapped in the vinyl coated cloth, or equivalent material 61 of which the bag is made, and thus the ring is an integral part of the tubular container body 62.

Figure 4:
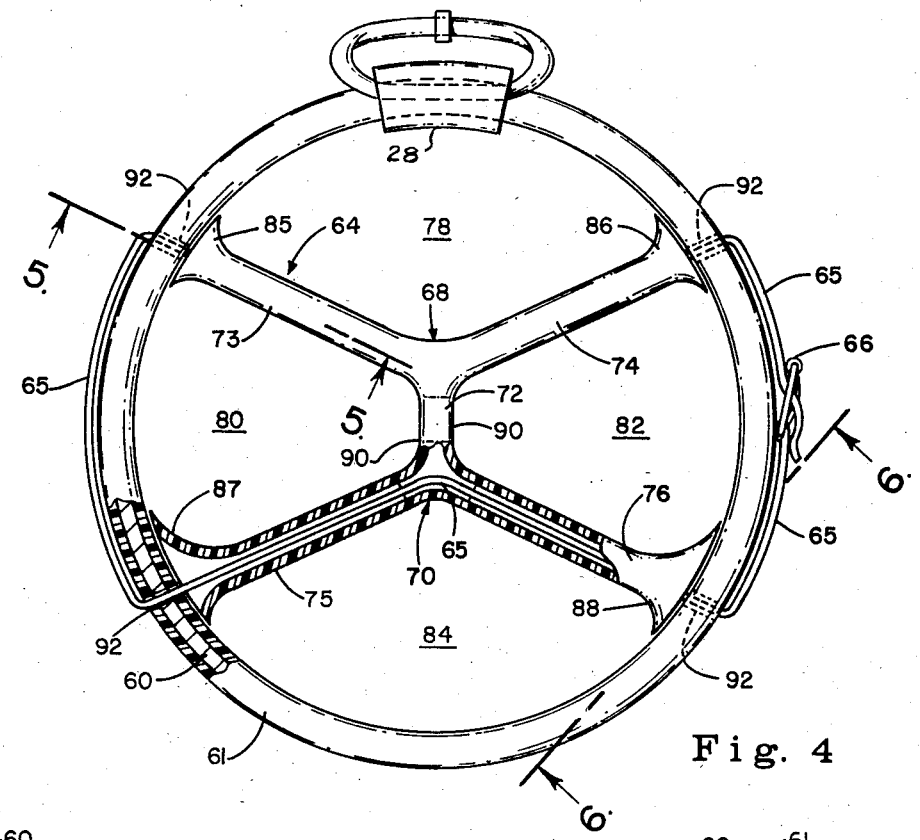
FIG. 4 is a view similar to FIG. 2 and showing a second embodiment of the present invention.
Figure 5:
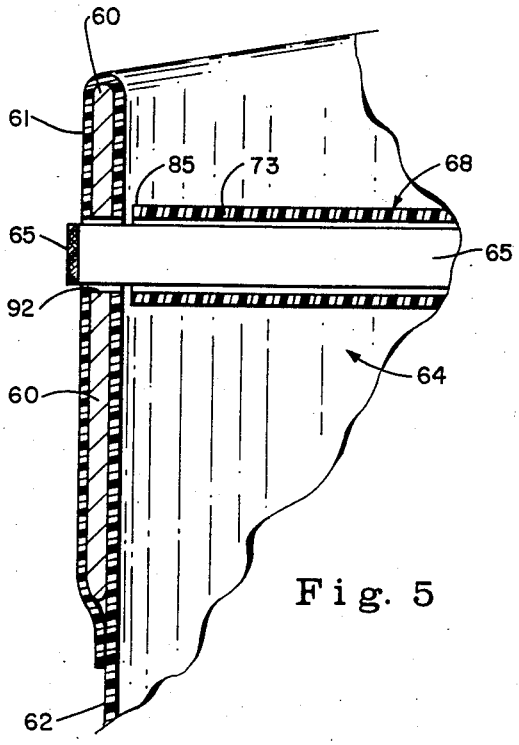
FIG. 5 is an enlarged fragmentary sectional view taken along the line 5—5 of FIG. 4
Figure 6:
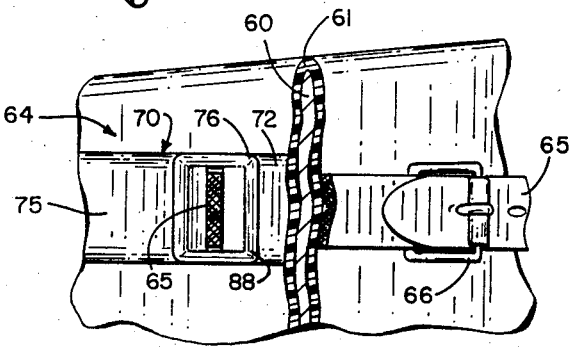
FIG. 6 is an enlarged fragmentary sectional view taken along the line 6—6 of FIG. 4.

When the ring-shaped body 60 is an integral part of the golf bag, the divider means 64 is formed as an insert which may be mounted in the ring-shaped body in various ways. As shown in FIGS. 4, 5 and 6, the divider means 64 is configured so that a strap 65 having a suitable buckle 66 on one end thereof is employed in the manner which will hereinafter be described in detail.

The divider means 64 is similar to the hereinbefore described divider means 30 and thus includes a pair of oppositely facing angular cross bars 68 and 70, which are bent at their centers with the centers being interconnected by a rib 72. The cross bar 68 has a pair of arms 73 and 74 which divergingly extend from one end of the center rib 72 and preferably define an obtuse included angle. The cross bar 70 has a pair of arms 75 and 76 which extend oppositely and divergingly from the opposite end of the center rib and also preferably define an obtuse included angle. In this manner, when the golf bag is being carried by the shoulder strap (not shown) the cross bar 68 defines the lower edge of the upper open golf club group segregation area 78. The other cross bar 70 will, in conjunction with the ring-shaped body 60, define the lower boundaries of the intermediate open golf club group segregation areas 80 and 82 and will further define the upper boundary of the lower open golf club group segregation area 84.

The extending terminal ends 85 and 86 of the arms 73 and 74, respectively, of the upper cross bar 68 are flared as shown as are the terminal ends 87 and 88 of the arms 75 and 76, respectively, of the lower cross bar 70. These flared ends 85, 86, 87 and 88 of the cross bars 68 and 70, along with the arcuate opposite sides 90 of the center rib 72, provide the radiused corners of the open segregation areas 78, 80, 82 and 84 in the manner hereinbefore fully described, and thus reduce golf club extraction problems.

The cross bars 68 and 70 are tubular with at least the extending ends 85, 86, 87 and 88 thereof being of enclosed cross section. The ends of the cross bars 68 and 70 are open and they align with slots 92 that are provided through the ring-shaped body 60. The strap 65 is threaded through the cross bars 68 and 70 and the aligned slots 92 and thus demountably attaches the divider means 64 within the ring-shaped body 60 in a manner well known in the art.

Figure 7:
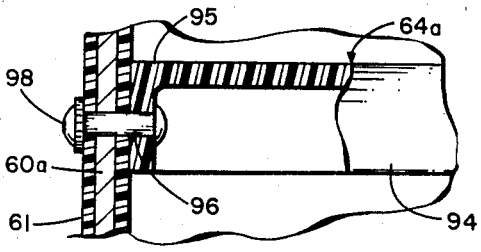
FIG. 7 is a fragmentary sectional view similar to FIG. 5 and showing a modified form of the second embodiment of the throat structure of the present invention.

A modified divider means **64*a* is shown in FIG. 7 as being mounted in the ring-shaped body 60*a*. In this modification, each of the four arms 94 (one shown) of the divider means 64*a* have their flared extending terminal ends 95 closed by means of an end wall 96, and suitable rivets 98, or other fastener means, may be used to mount the divider means 64*a* within the ring-shaped body 60*a***.

While the principles of the invention have now been made clear in the illustrated embodiments, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A throat structure for the top end of a golf bar comprising:

1 (a) a ring-shaped body means defining a bore; and 1 (b) divider means in the bore of said ring-shaped body to divide the bore into four separated open golf club segregation areas, said divider means including, I. a first cross bar having a center and including a pair of arms which extend oppositely and angularly from the center of said first cross bar with those arms being disposed to define an obtuse included angle therebetween, II. a second cross bar having a center and including a pair of arms which extend oppositely and angularly from the center of said second cross bar with those arms being disposed to define an obtuse included angle therebetween, III. said first and second cross bars being disposed so that the included obtuse angles defined by their respective pairs of arms face in opposite directions and being further disposed so that the centers of said first and second cross bars are in spaced apart relationship with respect to each other, IV. a rib transversely extending between the spaced apart centers of said first and second cross bars for interconnecting the spaced apart centers of said first and second cross bars.

2. A throat structure as claimed in claim 1 wherein the included angles defined by the pair of arms of said first and the pair of arms of said second cross bars are obtuse angles of about 130°.

3. A throat structure as claimed in claim 1 wherein said rib has opposite sides each of which is of arcuate configuration.

4. A throat structure as claimed in claim 3 wherein the opposite arcuate sides of said rib have a radius which is approximately equal to the largest radius of a gold club grip.

5. A throat structure as claimed in claim 1 wherein each of the opposite ends of said first and said second cross bars are flared to form radii at the junctions of the opposite ends of said first and said second cross bars and said ring-shaped body.

6. A throat structure as claimed in claim 5 wherein the radii formed at the junctions of the ends of said first and said second cross bars and said ring-shaped body are approximately equal to the largest radius of a golf club grip.

7. A throat structure as claimed in claim 1 wherein the upper surfaces of said first and said second cross bars lie in different spaced apart parallel planes.

8. A throat structure as claimed in claim 1 wherein said divider means and said ring-shaped body are formed as an integral unitary structure.

9. A throat structure as claimed in claim 1 wherein said divider means and said ring-shaped body are separate structures and means are provided for mounting said divider means in said ring-shaped body.

10. A throat structure as claimed in claim 1 and further comprising:

(a) said first cross bar of said divider means is tubular with the opposite ends being open and proximate the internal bore defining surface of said ring-shaped body;

(b) said second cross bar of said divider means is tubular with the opposite ends being open and proximate the internal bore defining surface of said ring-shaped body; and (c) means for mounting said divider means in the bore of said ring-shaped body.

11. A throat structure as claimed in claim 10 wherein said means for mounting said divider means in the bore of said ring-shaped body comprises:

(a) said ring-shaped body having four slots formed therethrough each of which aligns with a different one of the open ends of said first and said second cross bars of said divider means;

(b) strap means threadingly disposed in said first and said second cross bars of said divider means and passing through said slots of said ring-shaped body in a manner which places the opposite ends of said strap means proximate each other; and (c) means for releasably interconnecting the opposite ends of said strap means.

12. A throat structure as claimed in claim 11 wherein said means for releasably interconnecting the opposite ends of said strap means is a buckle.

13. A throat structure as claimed in claim 1 and further comprising:

(a) said first cross bar of said divider means is tubular with the opposite ends thereof being closed and proximate the internal bore defining surface of said ring-shaped body;

(b) said second cross bar of said divider means is tubular with the opposite ends thereof being closed and proximate the internal bore defining surface of said ring-shaped body; and (c) means for mounting said divider means in the bore of said ring-shaped body.

14. A throat structure as claimed in claim 13 wherein said means for mounting said divider means in the bore of said ring-shaped body comprises fastener means at each of the closed extending ends of said first and said second cross bars of said divider means for connection thereof to said ring-shaped body.

15. A throat structure for the top open end of a golf bag comprising:

(a) a ring-shaped body means defining a substantially cylindrical bore; and (b) divider means in the bore of said ring-shaped body for dividing the bore into a first open pair of diametrically opposed golf club segregation areas and a second open pair of diametrically opposed golf club segregation areas, said divider means including:

I. a first cross bat having a center and including a pair of arms which extend oppositely and angularly from the center of said first cross bar with those arms being disposed to define an obtuse included angle therebetween, II. a second cross bar having a center and inclduing a pair of arms which extend oppositely and angularly from the center of said second cross bar with those arms being disposed to define an obtuse included angle therebetween, III. said first and said second cross bars being disposed so that the included angles defined by their respective pairs of arms face in diametrically opposed directions and being further disposed so that the centers of said first and second cross bars are in spaced apart relationship with respect to each other, IV. a rib transversely extending between the spaced apart centers of said first and second cross bars for interconnecting the spaced apart centers of said first and second cross bars.

16. A throat structure as claimed in claim 15 wherein the included angles defined by the pair of arms of said first cross bar and the pair of arms of said second cross bar of said divider means are obtuse angles of approximately 130°.

17. A throat structure as claimed in claim 15 wherein said ring-shaped body and said divider means are formed as an integral unitary structure which is configured so that each of the corners of said first and said second open pairs of diametrically opposed golf club segregation areas are provided with a radius which is at least substantially as large as the largest radius of golf club grips.

18. A throat structure as claimed in claim 15 and further comprising:

(a) said first and said second cross bars of said divider means each having their opposed extending ends terminating proximate the inner bore defining surface of said ring-shaped body;

(b) means for connecting the terminal ends of said first and said second cross bars to said ring-shaped body;

(c) each of the terminal ends of said first and said second cross bars being flared to provide a radius at each corner of said first and said second open pairs of diametrically opposed golf club segregation acrea with those radii being at least substantially as large as the largest radius of a golf club grip; and (d) said rib having opposite sides which are curved inwardly toward each other and have a radius which is at least as large as the largest radius of a golf club grip.

* * * * *